United States Patent [19]

Gasser et al.

[11] 4,079,672

[45] Mar. 21, 1978

[54] INTERNAL NONROTARY BEARING HOUSING AND TENSIONING MEANS

[76] Inventors: Manfred Gasser, Romerweg 16, A 9061 Klagenfurt; Kurt Chabek, Zwanzgerberg 18, A-9065 Ebental; Johannes Zimmer, Ebentaler Strasse 133, A9020 Klagenfurt, all of Austria

[21] Appl. No.: 720,614

[22] Filed: Sep. 3, 1976

[30] Foreign Application Priority Data

Sep. 8, 1975 Austria ..... 6927/75

[51] Int. Cl.[2] ..... B41F 15/38

[52] U.S. Cl. ..... 101/128.1; 101/212; 308/233

[58] Field of Search ..... 101/115, 116, 122, 127.1, 101/128.1, 212, 375, 376; 29/115, 116 R; 308/174, 176, 233, 232, 20

[56] References Cited

U.S. PATENT DOCUMENTS

| | | | |
|---|---|---|---|
| 3,155,034 | 11/1964 | Reinke | 101/122 X |
| 3,556,004 | 1/1971 | Mitter et al. | 101/116 |
| 3,674,357 | 7/1972 | Ladin et al. | 308/233 |
| 3,721,188 | 3/1973 | Jacobsen et al. | 101/375 |
| 3,892,176 | 7/1975 | Van der Winden | 101/127.1 X |
| 3,921,775 | 11/1975 | Matyschik | 308/233 X |

FOREIGN PATENT DOCUMENTS

| | | | |
|---|---|---|---|
| 305,940 | 3/1973 | Austria | 101/128.1 |
| 836,793 | 4/1952 | Germany | 101/120 |
| 2,241,105 | 12/1973 | Germany | 101/128.1 |

OTHER PUBLICATIONS p. 32; Feb. 1976, "Screen Printing", by Brav.

*Primary Examiner*—Ronald E. Suter
*Attorney, Agent, or Firm*—Haseltine, Lake & Waters

[57] ABSTRACT

An arrangement on screen printing machines for interchangeable holding and lengthwise tensioning of rotary screens which have face-side end sections that can be connected to rotary holding sections. The holding sections are mounted on nonrotary bearing housings which are connected to at least one lengthwise carrier. The latter is located on the outside of the rotary screen, parallel to the screen axis, and fastened to the machine frame. The rotary holding sections enclose the nonrotary bearing housing peripherically from the outside. The bearing housings are connected to the lengthwise carrier by cross arms. The nonrotary bearing housing comprises a nonrotary hollow cylinder which projects beyond the rotary holding sections in axial, lenthwise, direction of the screen axis. The hollow cylinder, furthermore, may have at least two cylinder sections and a ring-shaped elastomer intermediate member located between the cylinder sections.

4 Claims, 3 Drawing Figures

INTERNAL NONROTARY BEARING HOUSING AND TENSIONING MEANS

BACKGROUND OF THE INVENTION

The present invention relates to an arrangement on screen printing machines for the interchangeable holding and lengthwise tensioning of rotary screens whose face-side end sections can be connected to the rotary holding sections. The holding sections are mounted on non-rotary bearing housings. These bearing housings are connected to at least one lengthwise carrier which is located on the outside of the rotary screen, parallel to the screen axis, and fastened to the machine frame.

There are already known in the art various designs relating to the interchangeable holding and lengthwise tensioning of rotary screens. Those arrangements where the screen holders are held by lengthwise carriers located outside the rotary screen, e.g., a pair of struts, are distinguished by the fact that practically the entire interior of the rotary screen is available for accommodating the ink supply and the squeegee device.

However, with the known or conventional arrangements of this type, the inside of the rotary screen is accessible only through sometimes very rapidly rotating parts of the screen holders, for example, through rotating inside sleeves of the screen holders (cf. Austrian Pat. No. 296,928, Austrian Pat. No. 302,378 and Austrian Pat. No. 303,659). These rotating components interfere with manipulation of the ink supply inside the screen of the screen printing device during printing and constitute a permanent safety hazard to the operating personnel.

It is, therefore, an object of the present invention to provide safe manipulation, during operation, of a screen holder of the initially mentioned type.

Another object of the present invention is to provide an arrangement of the foregoing character which is simple in construction and may be economically fabricated.

A further object of the present invention is to provide an arrangement, as described, which has a substantially long operating life, and may be readily maintained in service.

SUMMARY OF THE INVENTION

The objects of the present invention are achieved by providing that the rotating holding sections enclose the non-rotary bearing housings peripherically from the outside, and the bearing housings are connected via cross arms with the lengthwise carrier(s).

With the present invention, one may reach into the interior of the rotary screen mounted in the screen holder through open areas in the non-rotary bearing housings. The advantage attained by the invention becomes particularly clear when the bearing housing, comprises a non-rotary hollow cylinder which projects beyond the rotating holding section of the screen holder axially, i.e., in the lengthwise direction of the screen axis.

The improvements of the present invention also provide that the elements for the lengthwise tensioning of the rotary screen can be incorporated into the screen holder in such a way that at least one of the non-rotary bearing housings on the associated cross arm (which connects the bearing housing with the lengthwise carrier (s) outside the screen) is adjustably displaceable for lengthwise tensioning of the rotary screen. The displacement (shifting) and hence the lengthwise tensioning of the rotary screen can be accomplished by simple gripping lever mechanisms. In addition, with respect to the clamping forces, there is force linkage from the screen wall via the screen holders to the lengthwise carrier(s) and back to the screen wall.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
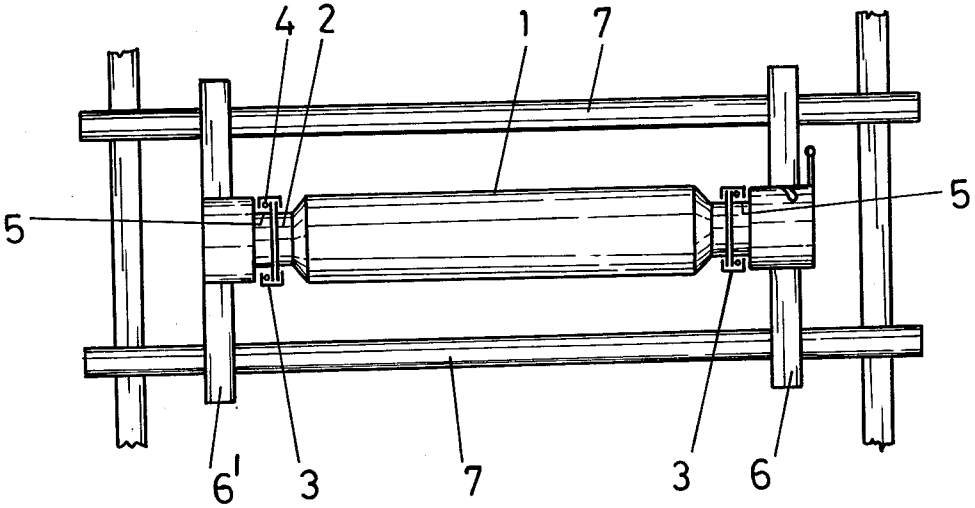
FIG. 1 shows a schematic of an embodiment of the present invention.

An embodiment of the arrangement in accordance with the present invention is shown in the schematic of FIG. 1. 1 denotes the rotary screen and 2 the face side end pieces (end rings) of the latter. The screen holder, at both face sides of the rotary screen 1, has a rotary holding section 3 which peripherally encloses on the outside a non-rotary bearing housing 5. Roller bearing housings 4 (axial bearings) are inbetween. The non-rotary bearing housing 5 is connected via cross arms 6, 6′ to the lengthwise supports 7. The non-rotary bearing housing 5 has the form of a hollow cylinder which projects axially beyond the outside of the rotary holding section 3 of the screen holder, i.e., when viewed in the direction of the screen axis. As a result, both the face side termination of the screen holder and the entire path leading to the inside of the rotary screen is formed by nonrotating components, so that nonhazardous operation in the face side regions of the screen holders is possible, and one may, without jeopardizing safety, reach into the inside of the rotary screen 1, e.g., for manipulating the squeegee device or the ink supply.

Figure 2:
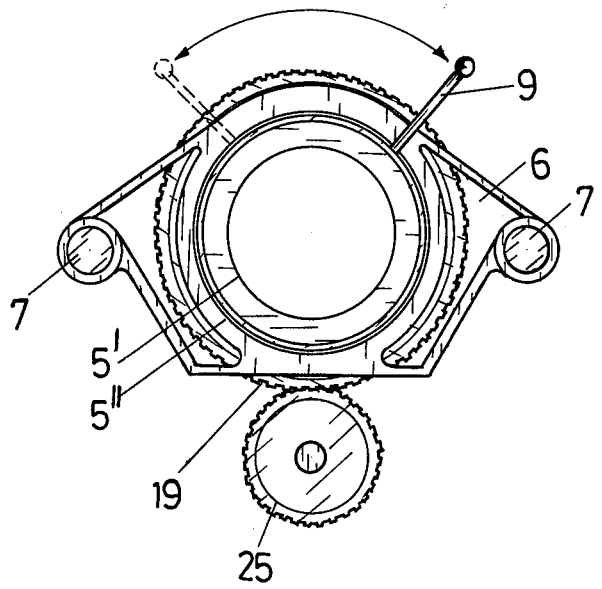
FIG. 2 shows a front view.
Figure 3:
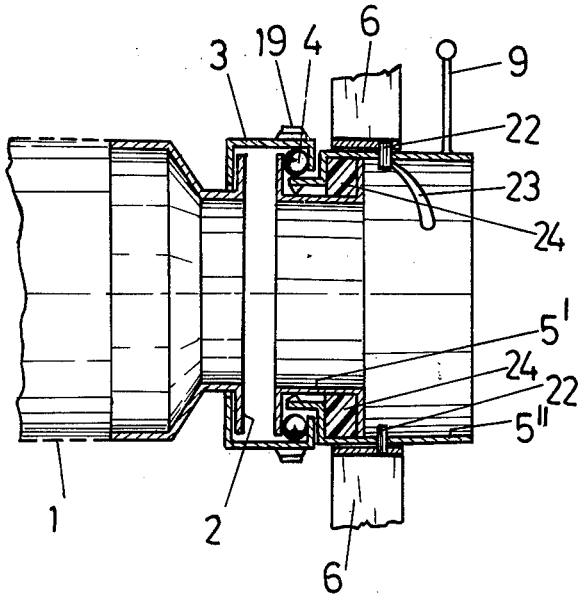
FIG. 3 shows a lengthwise section through one of the two screen holders.

FIGS. 2 and 3 show details of an embodiment of the construction schematic shown in FIG. 1. In FIGS. 2 and 3, the designation of the individual components with reference numerals corresponds to FIG. 1. However, FIGS. 2 and 3 indicate that the bearing housings which are located within the holder section 3 and which do not turn along with the rotary screen (which in its entirety is denoted by 5 in FIG. 1) comprise two parts, a hollow cylinder part 5′ and a hollow cylinder part 5″. Between the two parts 5′ and 5″ there is an elastomer (rubber elastic) intermediate ring 24 to compensate for inaccurate centering or distortions perpendicular to the shaft of the coupled components. The hollow cylinder part 5″ of the bearing housing is axially displaceable relative to the cross arm 6 fastened to the lengthwise supports 7. Cross arm 6 here has the shape of a bearing plate. As a result of the axial displacement of the part 5″, the rotary screen 1 is tensioned lengthwise. This axial displacement is due to the fact that the part 5″ on the cross arm is guided by trunnions 23 which engage grooves 23 (of which only one is shown in FIG. 3).

The rotary holding section 3, which is peripherically outside, for connecting the screen end section 2 also mounts drive gear 19 for driving the screen. The drive gear 19 meshes with the output gear 25 of the gear box.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An apparatus for use with screen printing machines adapted to enable interchangeable holding and lengthwise tensioning of rotary screens, said apparatus employing a machine frame; a rotary screen with face-side end sections; rotary holding sections removably connected to said rotary screen end sections; non-rotary bearing housings for mounting said holding sections; lengthwise support means located on the outside of said rotary screen, parallel to the axis of said screen and fastened to said machine frame; said bearing housings being connected to said lengthwise support means; said rotary holding sections enclosing said non-rotary bearing housings peripherally from the outside, and cross arms for connecting said non-rotary bearing housings to said lengthwise support means, wherein: said non-rotary bearing housings comprise non-rotary hollow cylinders projecting beyond said rotary holding sections of said screen end sections in an axial direction corresponding to the lengthwise direction of the axis of said screen end which is connected to said cross arms.

2. An apparatus as claimed in claim 1, wherein: said non-rotary bearing housings comprise at least two non-rotary hollow cylindrical sections and a ring-shaped elastomer intermediate member located between said cylindrical sections.

3. An apparatus as claimed in claim 1, wherein: said projecting hollow cylinder of at least one bearing housing being displaceably connected to respective cross arms for lengthwise tensioning of said rotary screen.

4. An apparatus as claimed in claim 2 wherein: one of said sections of at least one bearing housing projects axially outwardly beyond the other and is displaceably connected to the respective cross arm for lengthwise tensioning of said rotary screen.

* * * * *